US008480511B2

(12) United States Patent
Sargent et al.

(10) Patent No.: US 8,480,511 B2
(45) Date of Patent: Jul. 9, 2013

(54) METHODS FOR MARKING GOLF CLUB FERRULE

(75) Inventors: Nathan T. Sargent, Oceanside, CA (US); Abram Stanley Harris, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 89 days.

(21) Appl. No.: 13/184,192

(22) Filed: Jul. 15, 2011

(65) Prior Publication Data

US 2013/0017901 A1 Jan. 17, 2013

(51) Int. Cl.
*A63B 53/02* (2006.01)

(52) U.S. Cl.
USPC ..... 473/309; 427/331

(58) Field of Classification Search
USPC ..... 473/309; 427/331
See application file for complete search history.

(56) References Cited

U.S. PATENT DOCUMENTS

| | | | | |
|---|---|---|---|---|
| 8,075,417 | B2 * | 12/2011 | Thomas et al. | 473/246 |
| 2001/0036871 | A1 * | 11/2001 | Lampinski et al. | 473/351 |
| 2003/0012902 | A1 * | 1/2003 | Kim et al. | 428/35.7 |
| 2004/0235582 | A1 * | 11/2004 | Solheim et al. | 473/308 |
| 2006/0058124 | A1 * | 3/2006 | Summers | 473/583 |
| 2009/0286611 | A1 | 11/2009 | Beach et al. | |
| 2010/0041491 | A1 | 2/2010 | Thomas et al. | |
| 2010/0184533 | A1 * | 7/2010 | Colonna | 473/387 |
| 2010/0197424 | A1 | 8/2010 | Beach et al. | |
| 2010/0216566 | A1 | 8/2010 | Thomas et al. | |
| 2011/0152000 | A1 | 6/2011 | Sargent et al. | |

OTHER PUBLICATIONS

Photographs of Srixon Z-star driver, 2 pages, Jun. 13, 2011.

* cited by examiner

*Primary Examiner* — Michael Dennis
(74) *Attorney, Agent, or Firm* — Klarquist Sparkman, LLP

(57) ABSTRACT

Described herein are methods of creating markings on a golf club ferrule, some of which comprising providing a polymeric ferrule body having a first color; painting at least a portion of the ferrule body with a paint material, the paint material having a second color that is different than the first color, such as with a high contrast; and removing one or more portions of the paint material from the ferrule body, such as by laser engraving, to reveal respective portions of the first color, thereby forming one or more markings on the ferrule.

13 Claims, 8 Drawing Sheets

METHODS FOR MARKING GOLF CLUB FERRULE

FIELD

The application relates generally to ferrules for a golf club, markings thereon, and related methods for creating such markings.

BACKGROUND

Ferrules and sleeves can be used to join a golf club shaft to a golf club head. The sleeve and ferrule can be fixed together and fixed to the shaft tip to form a shaft assembly. The sleeve is inserted into the hosel of the club head and secured with a locking mechanism. In golf clubs where the connection between the shaft assembly and the club head is adjustable, the shaft assembly can be configured to be rotationally adjustable relative to the club head to provide a plurality of different orientations of the club head face relative to the longitudinal axis of the shaft. To help a user make such an adjustment, some golf clubs include informational markings on the club head and on the sleeve to help align the shaft assembly at a desired rotational alignment relative to the club head.

SUMMARY

Described herein are embodiments of ferrules and sleeves for a golf club, markings thereon, and related methods for creating such markings.

Some exemplary methods of creating markings on a golf club ferrule comprise providing a polymeric ferrule body having a first color; painting at least a portion of the ferrule body with a paint material, the paint material having a second color that is different than the first color; and removing one or more portions of the paint material from the ferrule body to reveal respective portions of the first color, thereby forming one or more markings on the ferrule. In some of these methods, removing one or more portions of the paint material from the ferrule body comprises laser engraving.

In some of these methods, the first color and the second color have a high contrast relative to one another. In some of these methods, CIELab L* value of the first color is greater than 75 and the CIELab L* value of the second color is less than 25. In some of these methods, the absolute value of the difference between the CIELab L* value of the first color and the CIELab L* value of the second color is at least 50.

In some of these methods, the ferrule body comprises a cellulosic material, such as white cellulose acetate material, and in some of these methods the paint material comprises a black gloss paint.

In some of these methods, painting at least a portion of the ferrule body with a paint material comprises painting a substantial portion of the outer surface of the ferrule body with the paint material.

In some of these methods, the ferrule is fixed to a shaft and a sleeve to form a shaft assembly, the shaft assembly being rotatably adjustable relative to a golf club head, wherein the markings on the ferrule visually indicate a rotational position of shaft assembly relative to the golf club head.

In some of these methods, the ferrule comprises a plurality of longitudinally oriented recesses and the markings are formed within the recesses.

In some of these methods, the markings comprise lines having small average line widths, such as less than 1.0 mm. In some of these methods, the markings comprise one or more outlined characters.

In some of these methods, the ferrule body is injection molded.

In some of these methods, removing one or more portions of the paint material from the ferrule body comprises masking the ferrule body prior to painting and removing the masking to reveal portions of the first color.

Some exemplary embodiments of a golf club ferrule comprise a polymeric ferrule body having a first color and defining an outer surface, and a cover layer comprising a paint material having a second color, the cover layer covering a substantial portion of the outer surface of the ferrule body, wherein one or more portions of the ferrule body are exposed through the cover layer, the exposed portions of the ferrule body forming informational markings on the ferrule.

In some of these methods, the difference between the CIELab L* value of the first color and the CIELab L* value of the second color is at least 50.

In some of these methods, the informational markings have an average line width of less than 1.0 mm.

In some of these methods, the ferrule is fixed to a shaft and a sleeve to form a shaft assembly of the golf club, the shaft assembly being rotatably adjustable relative to a golf club head, wherein the informational markings on the ferrule visually indicate a rotational position of the shaft assembly relative to the golf club head.

Some exemplary embodiments of a golf club comprise a golf club head and a shaft assembly adjustably attached to the golf club head, the shaft assembly comprising a shaft, a sleeve and a ferrule fixed together, the sleeve having an upper portion that includes at least one informational marking, the ferrule being positioned over the upper portion of the sleeve and comprising at least one feature such that the at least one informational marking can be seen through the at least one feature.

In some of these methods, the at least one feature comprises at least one opening in the ferrule or at least one transparent portion of the ferrule.

The foregoing and other objects, features, and advantages of the invention will become more apparent from the following detailed description, which proceeds with reference to the accompanying figures.

DETAILED DESCRIPTION

Described herein are embodiments of ferrules and sleeves for a golf club, markings thereon, and related methods for creating such markings. The following description is exemplary in nature and is not intended to limit the scope, applicability, or configuration of the invention in any way. Various changes to the described embodiments and methods may be made in the function and arrangement of the elements described herein without departing from the scope of the invention.

As used in this application, the singular forms "a," "an," and "the" include the plural forms unless the context clearly dictates otherwise. The phrase "and/or" means "and", "or" and both "and" and "or". The term "includes" means "comprises." Further, the term "coupled" generally means mechanically, electrically and/or chemically coupled or linked and does not exclude the presence of intermediate elements between the coupled or associated items absent specific contrary language.

Figure 1A:
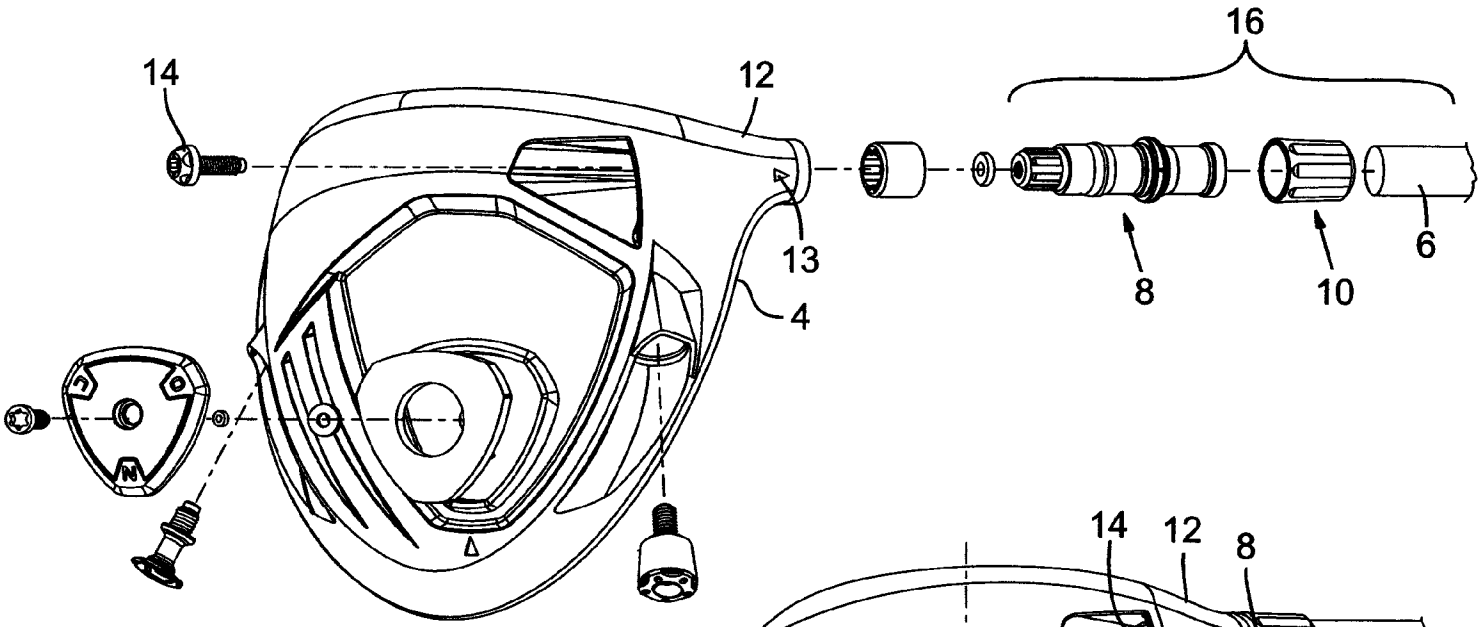
FIG. 1A is an exploded view of an exemplary golf club described herein.
Figure 1B:
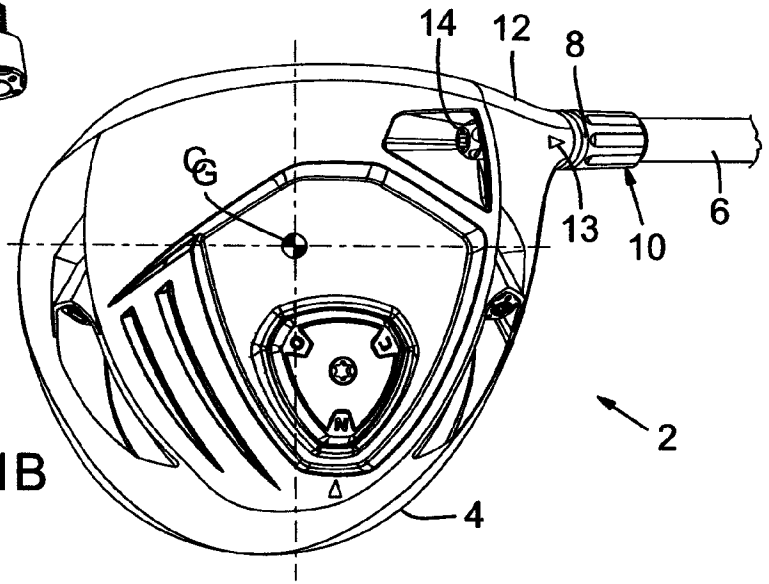
FIG. 1B is an assembled view of the golf club of FIG. 1A.
Figure 2:
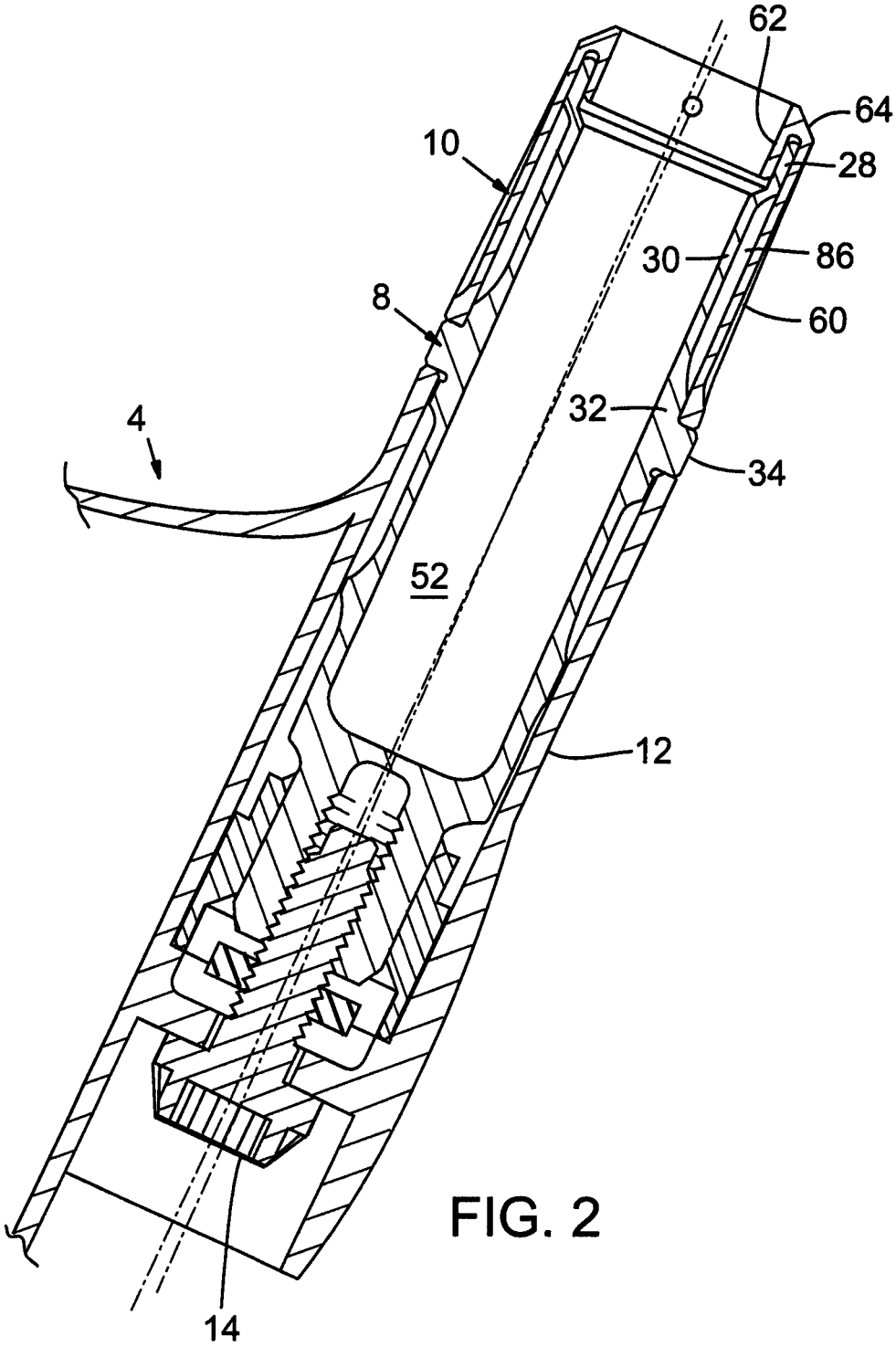
FIG. 2 is a cross-sectional view of a portion of the golf club of FIG. 1B, showing a connection between an exemplary ferrule, an exemplary sleeve, and an exemplary club head body.

As shown in FIGS. 1A and 1B, an exemplary golf club 2 can comprise a club head 4, a shaft 6, a sleeve 8, a ferrule 10, and various other components. As shown in FIG. 2, the ferrule 10 can be positioned over a first end portion of the sleeve 8 and an opposite end portion of the sleeve can be secured within a hosel 12 of the club head 4, such as by means of a screw fastener 14. A lower end portion, or tip, of the shaft 6 can extend through the ferrule 10 and into the sleeve 8. The shaft 6, sleeve 8 and ferrule 10 can be fixed together in a semi-permanent manner, such as by means of friction fits, adhesives, such as epoxy, and/or other conventional attachment means. This fixed assembly of the shaft 6, sleeve 8 and ferrule 10 is referred to herein as the shaft assembly 16.

The shaft assembly 16 can be rotationally adjustable with respect to the hosel 12. Adjusting the rotational position of the shaft assembly 16 relative to the hosel 12 can change the alignment of the club head 4 with respect to a longitudinal axis of the shaft 6. To aid in adjusting the rotational position of shaft assembly 16 relative to the hosel 12, one or more surfaces of the shaft assembly, such as exposed surfaces of the sleeve 8 and/or the ferrule 10, can include markings that can be aligned with an indicator on the hosel. As used herein, the term "markings" can include decorative markings that are for aesthetic purposes, as well as informational markings that are used to convey information to the user, such as information about the rotational positioning of the shaft assembly. The term "informational markings" includes markings that convey useful information to the user, such as information related to the functionality or adjustability of the golf club, and excludes markings that are only decorative. For example, informational markings can include an indication of loft, lie, face angle, or intended ball trajectory such as a "right" or "left" or "neutral" flight path. The structure of the shaft assembly 16 and its interaction with the club head 4 is described in greater detail in U.S. Patent Application Publication No. 2010/0197424 A1, which is incorporated herein by reference.

As shown in FIGS. 2 and 3A-3C, the sleeve 8 can include a top sleeve portion 20, a middle sleeve portion 22, and a bottom sleeve portion 24. The top portion 20 can include a tapered and recessed surface 26, a wide top rim 28, a narrow mid-section 30, and a wide lower portion 32. The top sleeve portion 20 can be covered by the ferrule 10 such that the top sleeve portion is not visible in the assembled golf club 2 (see FIGS. 1A and 2). The wide lower portion 32 of the top sleeve portion 20 is adjacent to an even wider shoulder region 34. The shoulder region 34 can include a bottom engaging surface 36 that abuts a top surface of the hosel 12, and a top engaging surface 38 that abuts a lower surface of the ferrule 10.

Figure 3C:
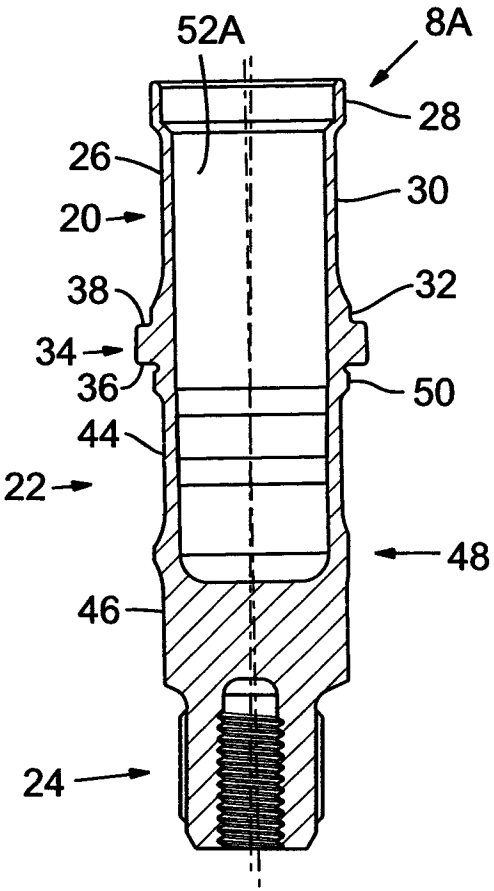
FIGS. 3A-3C are views of exemplary sleeves for use in the golf club of FIG. 1B.

As shown in FIG. 2, the shoulder region 34 can be visible in the assembled golf club between the ferrule 10 and the hosel 12. In some embodiments, the shoulder region 34 is the only portion of the sleeve 8 that is visible in the assembled golf club 2. The shoulder region 34 of the sleeve 8 can include informational markings that indicate the rotational orientation of the sleeve 8 with respect to the hosel 12 of the club head 4. For example, markings 40 on the shoulder region 34, as shown in FIG. 3A, can be aligned with an indicator 13 located on the visible exterior surface of the hosel 12.

Additional sleeve markings 42 can also be located on the middle sleeve portion 22. These markings 42 can be hidden within the hosel 12 when the golf club is assembled. In some embodiments, such as the embodiment shown in FIG. 8B, the top sleeve portion 20 can also include markings that are visible through openings in the ferrule 10.

The middle sleeve portion 22 can include a first section 44 and a second section 46. The first section 44 and second section 46 can be separated by a ridge portion 48. The first section 44 can include an upper engaging surface 50 that is adjacent and generally perpendicular to the lower surface 36 of the shoulder region 34.

Figure 3B:
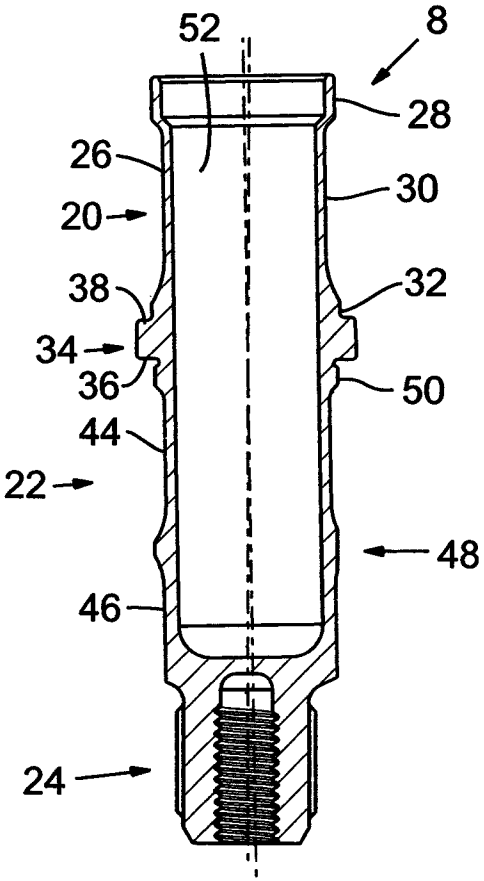
Figure 3A:
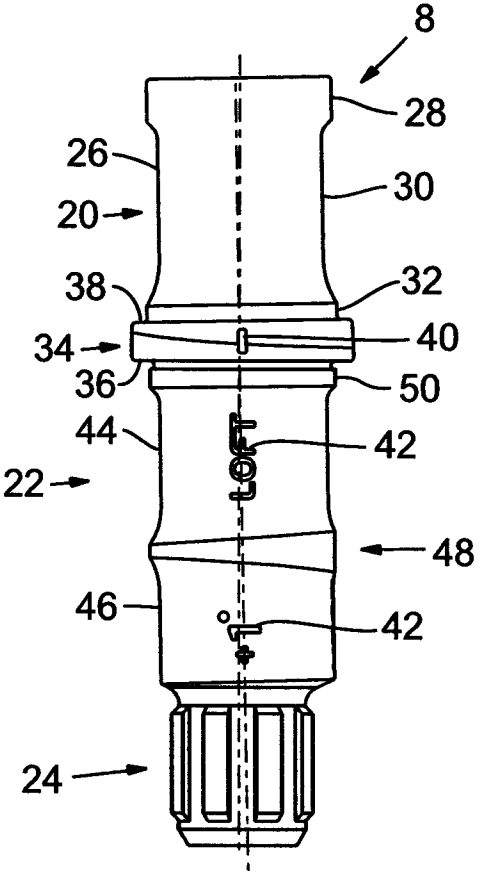

FIG. 3B illustrates a cross-sectional view of the sleeve 8, showing an interior opening 52 configured to receive the lower tip of the shaft 6. FIG. 3C illustrates an alternative sleeve embodiment 8A having the same or similar exterior features as the sleeve 8, but wherein the opening 52A is shallower and/or has a different diameter(s) than the opening 52 in the sleeve 8.

The sleeve 8 can be made of a strong, lightweight base material, such as an aluminum alloy (Al 7075-T6 for example), or other strong materials, such as a steel material. This base material can have a bright, metallic color. At least some surfaces of the sleeve 8 can further be anodized and/or painted one or more colors, such as darker colors that contrast with the color of the base material. Anodizing a metallic base material prior to painting it can provide greater adhesion and durability of the paint. In some embodiments, the shoulder region 34 of the sleeve 8 is painted black and the surfaces below the shoulder region that are inserted into the hosel 12, including the middle and lower sleeve portions 22, 24, are painted red. The top sleeve portion 20 is covered by the ferrule 10 and can be painted any color or not painted.

Markings on the sleeve 8, such as the markings 40, 42, can be created in various ways. In some embodiments, sleeve markings can be created by painting over the darker colored paint with a lighter, contrasting colored paint, such as a white paint. In some embodiments, sleeve markings can comprise areas of the base material that are not painted or where the paint has been removed. For example, in some embodiments markings can be created by masking portions of the base material prior to painting, then removing the masking to reveal the contrasting color of the base material beneath the paint. In some embodiments, markings can be created by removing portions of the paint to reveal the contrasting color of the base material underneath the paint. For example, portions of the dark paint can be removed with a laser engraving process to reveal the contrasting color of the base material.

As shown in FIGS. 4A-4D, some embodiments of the ferrule 10 can comprise an outer wall 60 and an inner wall 62. The outer wall 60 can include a tapered upper portion 64 that connects to the top of the inner wall 60. The inner wall 60 can have an annular inner surface 66 that defines an opening 68 for receiving the shaft 6. The diameter of the opening 68 can be slightly larger than the corresponding shaft tip diameter. The ferrule can include a plurality of protrusions 70 that extend into the opening 68 from the side wall 66 and that can contact the shaft 6 to center the shaft with respect to the ferrule 10.

Figure 4A:
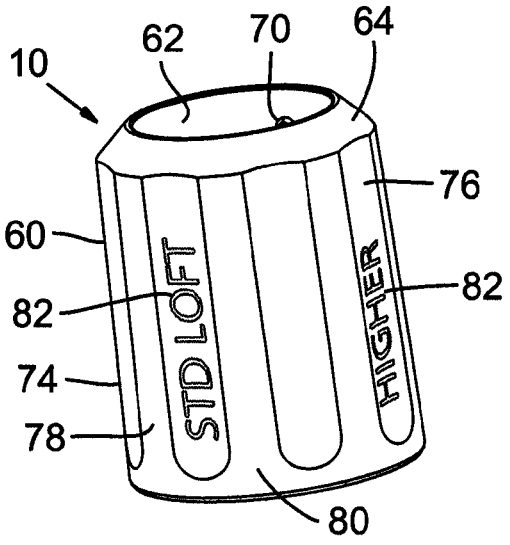
FIG. 4A is a perspective view of an exemplary ferrule having markings, for use in the golf club of FIG. 1B.
Figure 4B:
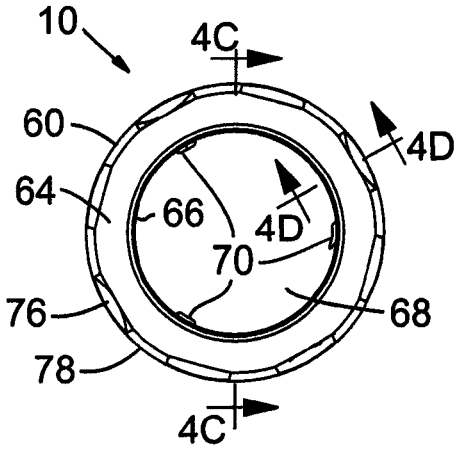
FIG. 4B is a top view of the ferrule of FIG. 4A.
Figure 4C:
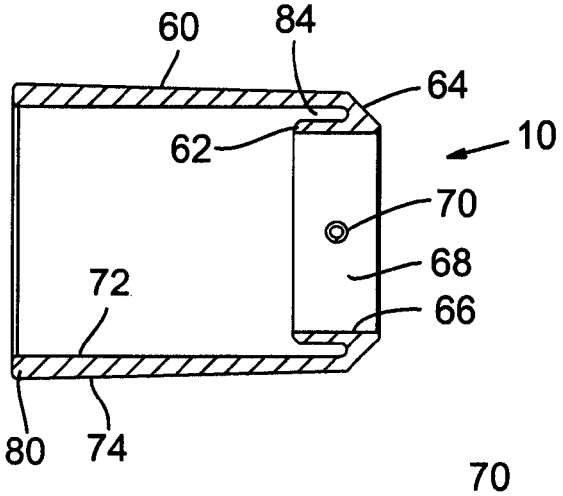
FIG. 4C is a cross-sectional view of the ferrule of FIG. 4B, taken along section line 4C.
Figure 4D:
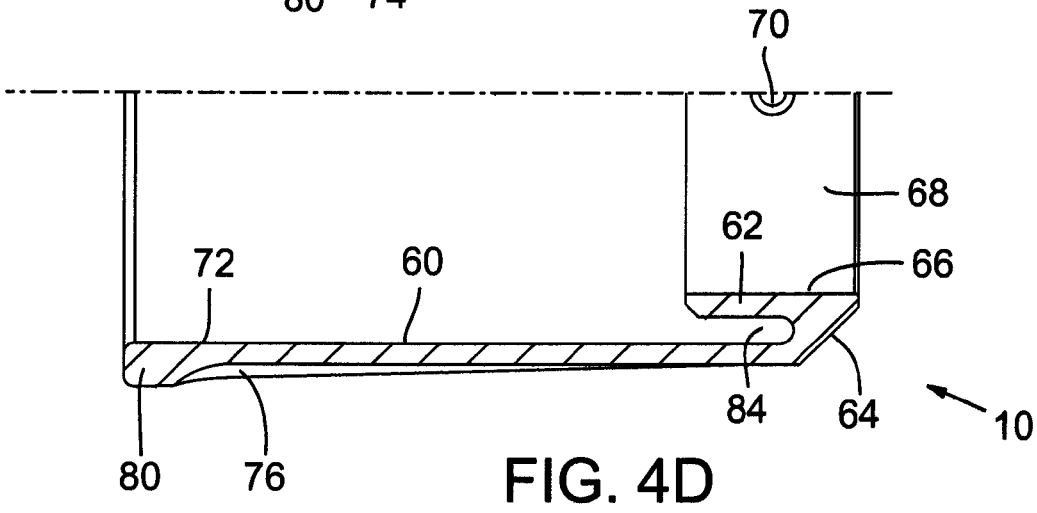
FIG. 4D is a cross-sectional view of the ferrule of FIG. 4B, taken along section line 4D.

The outer wall 60 of the ferrule 10 can have a generally cylindrical inner surface 72 that is hidden when the golf club is assembled and an outer surface 74 that is exposed when the golf club is assembled. The outer surface 74 includes all of the exposed surfaces, including the tapered upper portion 64, a lower portion 80, a plurality of longitudinal recesses 76 and a plurality of longitudinal ridges 78. The recesses 76 and the ridges 78 can be formed in an alternating pattern around the outer wall 60 as shown in FIG. 4A. The recesses 76 and ridges 78 can extend between the tapered upper portion 64 of the ferrule 10 and the lower portion 80 of the ferrule. Eight recesses 76 and eight ridges 78 are shown in FIGS. 4A-4D, but other embodiments of the ferrule 10 can include more or fewer recesses. The outer wall 60 of the ferrule 10 can be generally tapered from a greater outer diameter at the lower portion 80 to a narrower outer diameter adjacent the tapered portion 64. As shown in FIG. 4D, the ridges 78 can also taper in thickness from the lower portion 80 toward the upper tapered portion 64, such that the recesses 76 are deeper adjacent the lower portion 80 and shallower adjacent the tapered portion 64. The ridges 78 and recesses 76 can provide a better grip for the user, compared to a smooth outer surface 74, for twisting the shaft assembly 16. Ferrule markings, such as the illustrated markings 82, can be located in the recesses 76 and/or on other portions of the outer surface 74.

As shown in FIG. 4D, an annular cavity 84 can be formed between the inner wall 62 and the outer wall 60. As shown in FIG. 2, when the golf club 2 is assembled, the annular cavity 84 can fittingly receive the top rim 28 of the sleeve 8, such as with an interference fit, while the lower portion 80 of the ferrule 10 can abut the top edge 38 of the shoulder region 34 of the sleeve 8 and fit tightly around the wide lower portion 32 of the top sleeve portion 20, such as with an interference fit. In addition to these contact regions between the ferrule 10 and the sleeve 8, a space 86 defined between the outer wall 60 of the ferrule 10 and the mid-section 30 of the top sleeve portion 20 can be filled with an adhesive, such as epoxy, to help fix the ferrule 10 to the sleeve 8.

The ferrule 10 can comprise a ferrule body and a paint material applied to outer surfaces of the ferrule body. The ferrule body can be made of a lightweight material, such as a polymeric material. The material of the ferrule body can be less strong and lighter weight than the base material of the sleeve 8 because, unlike the sleeve, the ferrule does not need to transfer large forces between the shaft 6 and the club head 4. By constructing the ferrule 10 of a lighter weight material, the center of gravity of the golf club 2 can be lowered, or moved closer to the sole of the club head 4. The color of the ferrule body can be a light color, such as a white color.

In some embodiments, the ferrule body can comprise a cellulosic material, such as a cellulose acetate material having a hardness of 55 shore D. In other embodiments, the ferrule body can comprise one or more other polymeric materials, such as, but not limited to, cellulosics such as cellulose acetate, cellulose acetate butyrate, cellulose acetate propionate, ethyl cellulose and cellulose propionate, ethylene vinyl acetate, ethylene vinyl alcohol, fluoropolymer, ionomer, nylon, aromatic polyamide, polyarylates, polyarylether, polyarylsulfone, polybutylene, polycarbonate, polyester, polyestercarbonate, polyetheretherketone, polyethylene, polyimide, polypropylene, polystyrene and styrene copolymers, polysufone, polyvinyl chloride, polyvinylidene dichloride, polyurethane, and combinations of these and/or other polymers.

The colors described herein can be defined and measured with respect to the CIELab color space using L*, a*, b* color values. As used herein, L* is referred to as lightness and ranges between 0 and 100, wherein an L* value of 0 represents black and an L* of 100 represents a perfect white diffuser. In some embodiments, the CIELab L* value of the ferrule body can be greater than 50, 60, 70, 75, 80, 85, 90, and/or 93.

The polymeric material of the ferrule 10 can be more difficult to paint and mark, however, compared to the metallic material of the sleeve 8, partly because the polymeric material of the ferrule body cannot be anodized prior to painting. In some embodiments, at least a portion of the outer surface 74 of the ferrule 10 can be painted with a paint material having different color and/or L* value than the color of the ferrule body, for example a darker color, such as a gloss black, that contrasts with the lighter color of the ferrule body. As used herein, the terms "paint", "painted", "painting" and the like are used in a general sense to refer to any type of process for covering the ferrule body with a thin layer of another material, such as to change the color, protect the ferrule body, etc. In some embodiments, the CIELab L* value of the paint material on the ferrule 10 can be less than 60, 50, 40, 30, 25, 20, 15, 10 and/or 5.

In some embodiments, all and/or a substantial portion of the outer surface 74 of the ferrule 10 can be painted with a paint material having a different color than the ferrule body. As used herein, the term "a substantial portion of the outer surface" can mean at least 25%, at least 50%, at least 75%, at least 85%, at least 90% and/or at least 95% of the outer surface 74.

To create markings on the ferrule 10, one or more portions of the paint material can be removed, such as by using a laser, in for example a laser engraving process, to reveal the contrasting color of the ferrule body. Using a laser engraving process to create markings can result in more accurate, more detailed and more durable markings. Laser engraving can also allow for faster and more efficient manufacturing processes.

In other embodiments, portions of the ferrule body to be marked can first be masked, then the ferrule body can be painted, and then the masking can be removed to reveal the color of the ferrule body and thereby form the markings.

By creating the markings on the ferrule using laser engraving, the markings can be made highly visible and can have greater definition. For example, smaller characters and thinner line widths can be achieved by using laser engraving than with conventional marking methods. In some embodiments, ferrule markings can comprise average line widths of less of than 1.0 mm, 0.5 mm, 0.1 mm, 0.07 mm, 0.05 mm, 0.04 mm, 0.03 mm, 0.02 m, 0.01 mm and/or 0.001 mm. In some embodiments, the ferrule markings can comprise character font sizes of less than 12 point, 10 point, 8 point, 6 point, 5 point, 4 point, 3 point and/or 2 point. In some embodiments, the ferrule markings can comprise characters having average heights of less than 5 mm, 3 mm, 2 mm, 1 mm, 0.5 mm and/or 0.1 mm. While being small, such markings can be highly visible to the user due to the precision of the marking process and the high contrast of the colors.

In some embodiments, outlined markings (such as markings 82 in FIG. 4A) can be created by forming a thin line, or outline, around the perimeter of a portion of paint material in a desired shape, such as a letter or logo, such that the marking comprises the engraved outline as well as the portion of paint material within the outline. In this way, a larger marking can be formed without having to remove as much paint. The outline can have an average line width as described in the preceding paragraph, and the marking (a letter, logo, etc.) can have a character font size and/or average height as described in the previous paragraph. In some embodiments, such markings can be created in the recesses 76 and/or on other portions of the ferrule 10.

A high contrast can be achieved between the color of the ferrule body and the color of the paint material. For example, a white color of the ferrule body can provide high contrast relative to a black color of the paint material. The term "contrast" is defined herein as the absolute value of the difference between the L* values of two adjacent colors, and can be represented by "ΔL*". For example, if the L* value of the ferrule body color is 75 and the L* value of the paint material color is 25, then the contrast, or ΔL*, between the paint material color and the ferrule body color is 50. In some embodiments, ΔL* between the paint material color and the ferrule body color can be greater than 25, greater than 40, greater than 50, greater than 60, greater than 70, greater than 75, greater than 80, greater than 85 and/or greater than 90. In some embodiments, the ferrule body color and the paint material color can have a "high contrast," which can be defined as a ΔL* value that is greater than 40, greater than 50, greater than 60, greater than 65, greater than 70 and/or greater than 75 (if not otherwise defined, the term "high contrast" in a claim means a ΔL* value greater than 40). In one particular embodiment, the L* value of the ferrule body is 25 and the L* value of the paint material is 75, making ΔL* equal to 50, which is a high contrast because it is greater than 40.

Because the ferrule markings can be negative images engraved out of the paint material, the markings can be more resistant to chipping off or wearing away than if the markings were formed by painting the markings positively onto the ferrule body. The painted areas surrounding the engraved markings can have much larger area than the engraved markings themselves, such that the engraved markings, or "relief" markings, are more durable than if the markings were made by positively painting the markings onto the ferrule body. In the latter case, the markings would be formed of small areas of paint (thin lines, small characters) that can more easily be chipped off or worn away compared to engraved markings.

Also, because the ferrule markings can be made with greater precision and smaller sizes, more markings can be placed in smaller areas on the ferrule 10. For example, with laser engraving, words with more letters can be included in a given surface area. For example, for a given area on the ferrule 10, instead of just using an abbreviation, such as "STD", as a marking, the whole word "STANDARD" or a longer phrase like "STD LOFT" can be used as the marking. This can provide the user with more information and reduce confusion as to what the markings mean.

Figure 5A:
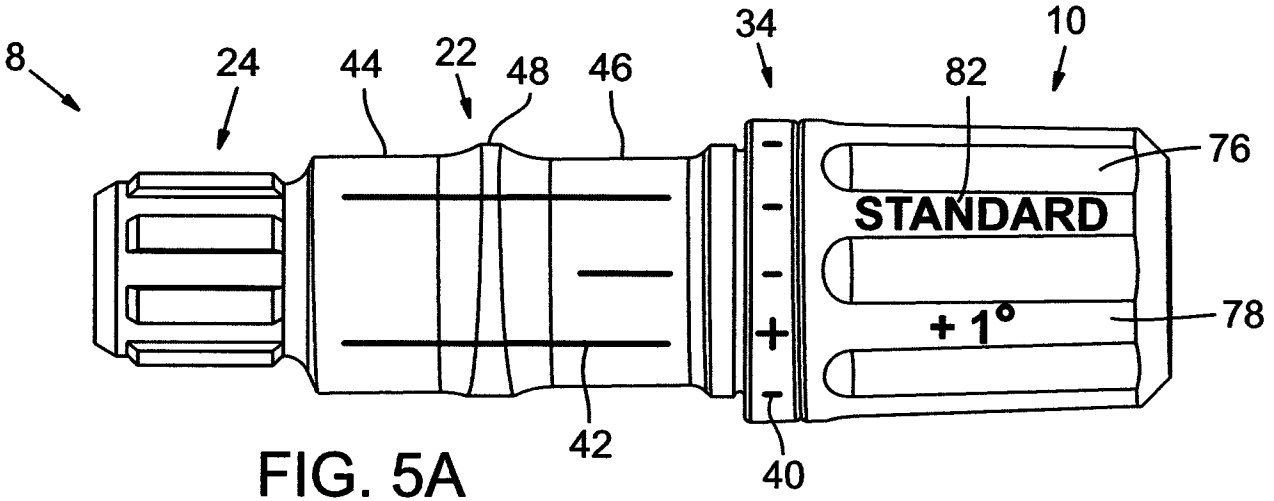
FIGS. 5A and 5B are side views of an exemplary combination of a sleeve and a ferrule, including exemplary markings, the combination for use with the golf club of FIG. 1B.
Figure 5B:
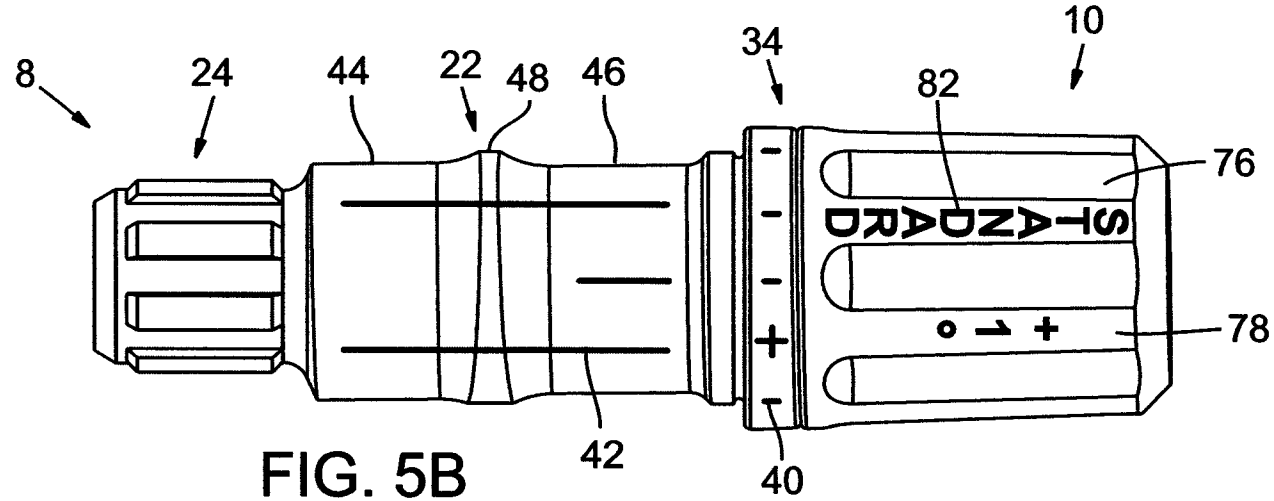

Laser engraved markings on the ferrule 10 can be located on various areas of the outer surface of the ferrule. As shown in FIG. 4A, markings 82 can be located in the recesses 76. In some embodiments, markings can be located on the ridges 78, as shown in FIGS. 5A and 5B. Markings in the recesses 76 can be more durable than markings on the ridges, as the users hands make more contact with the ridges 78 and can wear the ridge surfaces more significantly over time. Markings can also be located on the lower portion 80 of the ferrule.

The ferrule markings 82 can corresponds with sleeve markings 40 on the shoulder region 34 and sleeve markings 42 on the middle sleeve portion 22 to indicate plural orientation positions of the shaft assembly 16. The sleeve markings 42 can be formed to extend over the ridge 48 between the top and bottom sections 46, 44 of the middle sleeve portion 22. At least one additional marking, such as the indicator 13 shown in FIGS. 1A and 1B, can be included on the hosel 12. The markings on the sleeve and ferrule that align with the indicator 13 on the hosel can indicate to the user the rotational relationship between the shaft assembly 16 and the club head 4.

The available surface area of the ferrule 10 can be much greater than the available surface area of the shoulder region 34 of the sleeve 8. Thus, it can be desirable to include markings on the ferrule 10 in addition to, or in place of, the markings 40 on the shoulder region 34. Larger markings and markings with more characters can be included on the ferrule 10 as opposed to the smaller shoulder region 34. As shown in FIGS. 5A and 5B, markings 82 on the ridges of the ferrule 10 can include characters written in different orientations, such that they can be easily read when the shaft assembly is positioned horizontally or vertically. Because the markings 82 on the ferrule 10 can be descriptive enough to be self-explanatory, the markings 40 on the shoulder region 34 of the sleeve 8 can be less descriptive or not included. This can allow for a smaller shoulder region 34 and thus a smaller and lighter sleeve 8. As the sleeve 8 is generally comprised of a heavier material than the ferrule 10, a smaller sleeve and larger ferrule can result is less overall weight in the shaft assembly 16, which can lower the center of gravity of the golf club and/or allow the difference in weight to be redistributed to another part of the club, such as in the club head 4. In addition, as the ferrule 10 is fixed to the sleeve 8, the sleeve markings 40 and the ferrule markings 82 can combine together to from larger markings that cross over both the ferrule 10 and the shoulder region 34.

Having more information present in the markings 40 and 82 can allow a user to more readily understand the markings when the golf club is assembled and the markings 42 are hidden within the hosel 12. For example, when a golfer looks at an assembled club and only sees a single letter, such an "L", on the shoulder region 34 that is aligned with an indicator on the hosel, the user may not know what "L" stands for (does it mean "LOFT", "LEFT" or some other concept?), and may need to refer to a manual or disassemble the shaft assembly from the hosel 12 to read additional markings on the hidden parts of the sleeve to understand what "L" stands for. This can be time consuming, annoying, and/or impossible, such as if the golfer is in the middle of a round of golf. However, if the golfer looks at the assembled club and sees the marking "LEFT" on the ferrule 10, instead of just "L", the user can intuitively understand that aligning that marking with the indicator 13 on the hosel will result in ball traveling more to the left on a shot. And if the user sees the marking "LEFT 2°", the user can get even more information from the marking.

Figure 6A:
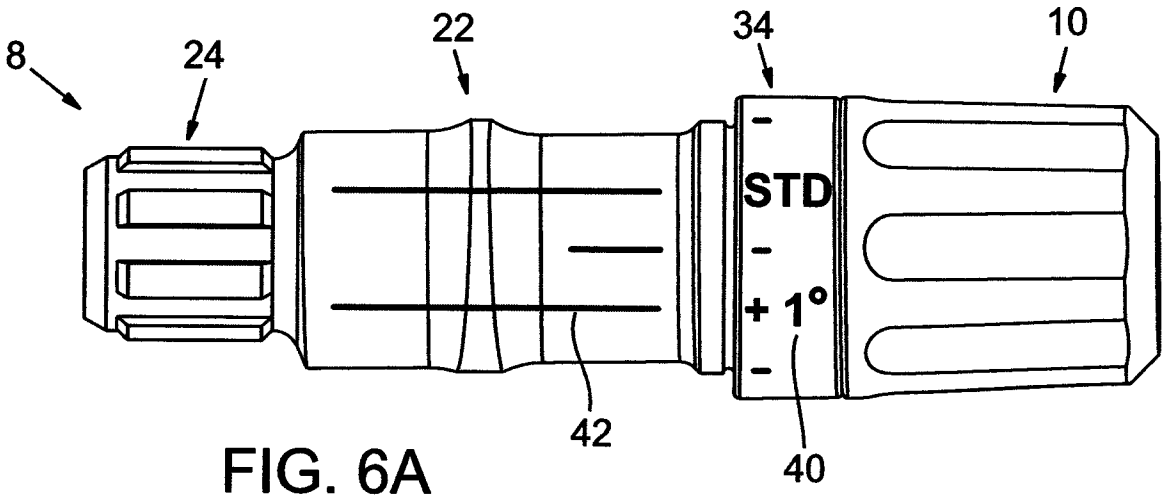
FIGS. 6A and 6B are side views of another exemplary combination of a sleeve and a ferrule, including exemplary markings, the combination for use with the golf club of FIG. 1B.
Figure 6B:
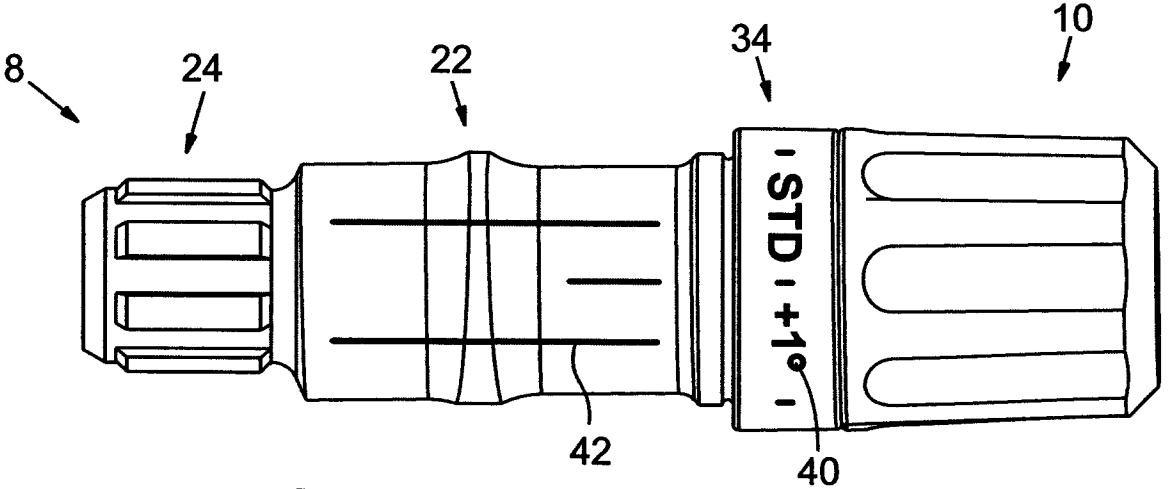
Figure 7A:
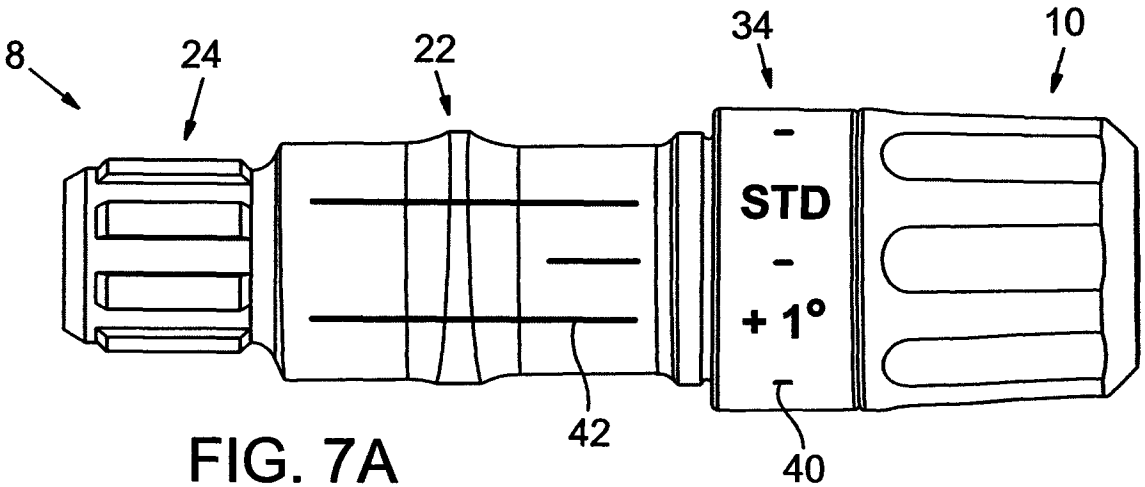
FIGS. 7A and 7B are side views of yet another exemplary combination of a sleeve and a ferrule, including exemplary markings, the combination for use with the golf club of FIG. 1B.
Figure 7B:
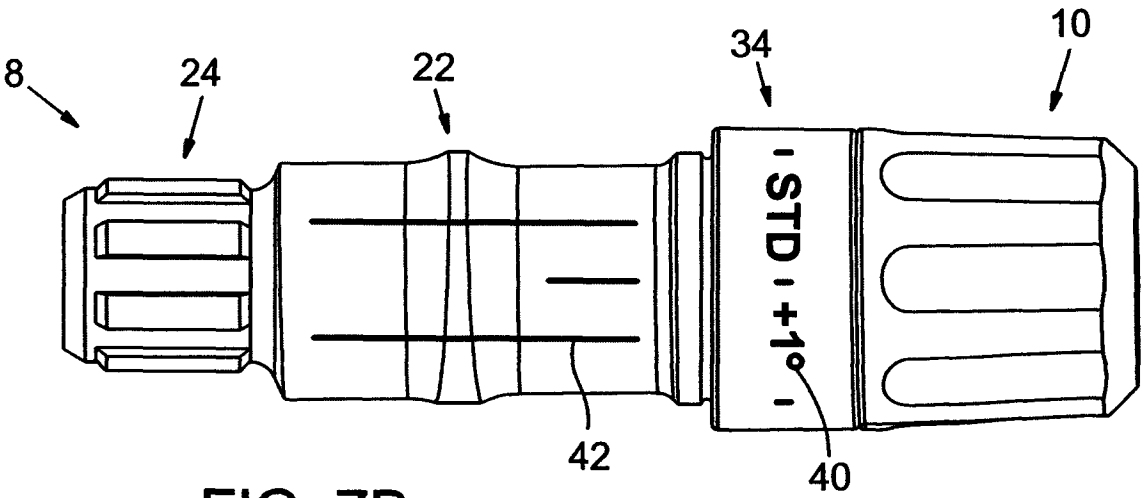

As shown in FIGS. 6 and 7, in some embodiments the shoulder region 34 of the sleeve 8 can nevertheless be made thicker and the ferrule 10 can be smaller. This can allow for additional and/or more detailed markings to be located on the shoulder region 34. With sufficient markings on the shoulder region 34, the ferrule 10 can be free of markings or have less detailed markings while still providing enough information to a user when the golf club is assembled.

The outer surface of the ferrule 10 can include a protectant layer, or cover layer, that can be applied after the markings 82 are created. The protectant can help protect the painted surfaces and the portions of the ferrule body that are exposed at the markings 82 from dirt, scratches, wearing, corrosion, and/or other damage. In addition, a glossy finish can be applied to all exposed surfaces to further protect the surfaces and provide a desirable appearance.

Figure 8A:
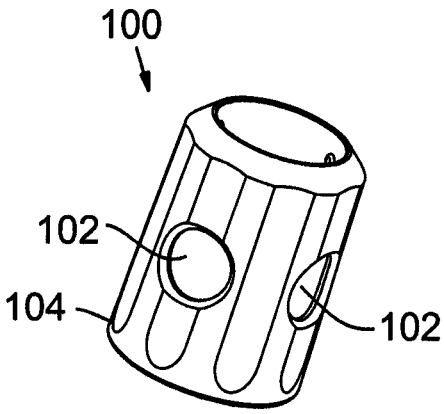
FIG. 8A is a perspective view of an exemplary ferrule having openings.
Figure 8C:
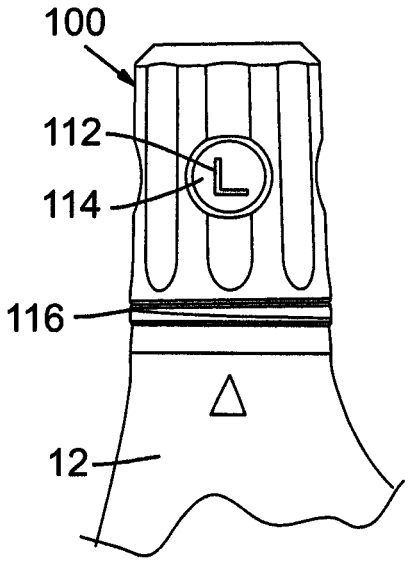
FIG. 8C is an assembled view of the portion of the golf club shown in FIG. 8B, showing the markings on the sleeve being visible through the openings in the ferrule.
Figure 8B:
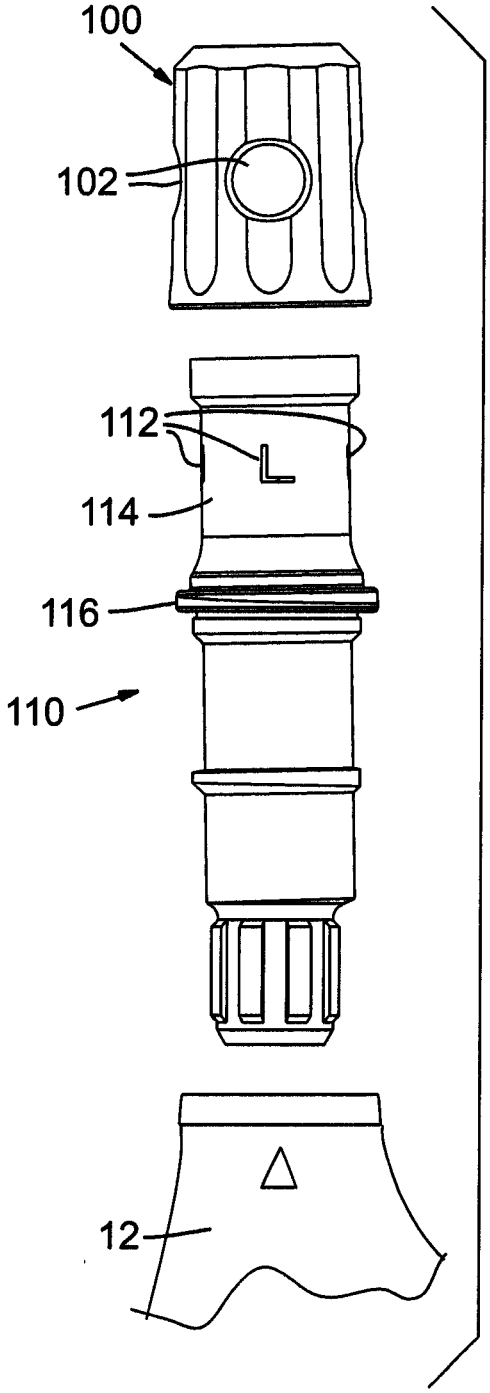
FIG. 8B is an exploded view of a portion of an exemplary golf club, showing a sleeve having markings on an upper portion and the ferrule of FIG. 8A.

As shown in FIGS. 8A-8C, alternative embodiments of a ferrule 100 can comprise one or more features that allow a user to see through the ferrule 100 and view the sleeve 8 beneath the ferrule. For example, such features can comprise one or more windows 102 in the outer wall 104 of the ferrule. In other embodiments, such features can comprise one or more transparent portions of the ferrule.

The ferrule 100 can be fixed to an alternative embodiment of a sleeve 110 that includes markings 112 on the top sleeve portion 114 above a shoulder region 116. The markings 112 can be formed by laser engraving a paint layer applied to the top sleeve portion 114. In some embodiments, the top sleeve portion 114 is anodized and painted a red color and the markings 112 are laser engraved through the red paint to reveal the bright metallic color of the underlying aluminum base material of the sleeve 8. In some of these embodiments, the ferrule 100 can have a black painted outer surface and can have at least one window 102 that exposes a red painted top sleeve portion 102 with a metallic colored marking in the center. The colors of the paint used on the sleeve and the ferrule can vary to provide a desired contrast, such as a high contrast, and/or other visual characteristics. In some embodiments, the markings 112 can be formed in other ways, such as by a masking process or by painting the markings onto an otherwise unpainted top sleeve portion 114.

In the embodiment shown in FIGS. 8A-8C, the ferrule 100 includes four windows 102 that align with four markings 112 on the sleeve 8. In other embodiments, more or fewer windows 102 and markings 112, such as 3 or fewer to 8 or more, can be included, though the number of windows and the number of markings are generally the same. In some of these embodiments, the ferrule 100 can be free of markings. In others of these embodiments, the ferrule 100 can include markings, like the markings 82 shown in FIG. 4A, in addition to the widows 102.

In other embodiments (not shown), the ferrule body can be made from a material that is clear or at least partially transparent, such that a user can see through the ferrule body and see the top sleeve portion beneath the ferrule. In some of these embodiments, the ferrule body can be painted with a dark colored paint material, and then laser engraved to expose the transparent ferrule body. The underlying top sleeve portion can be bare metal or painted to have a high contrast compared to the color that the ferrule is painted. In other embodiments, a portion of the clear ferrule body is left unpainted, and the underlying top sleeve portion includes markings that can be seen through the unpainted portions of the clear ferrule body.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. A method of creating markings on a golf club ferrule, comprising: providing a polymeric ferrule body having a first color; painting at least a portion of the ferrule body with a paint material, the paint material having a second color that is different than the first color; and removing one or more portions of the paint material from the ferrule body to reveal respective portions of the first color, thereby forming one or more markings on the ferrule; wherein removing one or more portions of the paint material from the ferrule body comprises laser engraving.

2. The method of claim 1, wherein the first color and the second color have a high contrast relative to one another.

3. The method of claim 1, wherein the CIELab L* value of the first color is greater than 75 and the CIELab L* value of the second color is less than 25.

4. The method of claim 1, wherein the absolute value of the difference between the CIELab L* value of the first color and the CIELab L* value of the second color is at least 50.

5. The method of claim 1, wherein the polymeric ferrule body comprises a white cellulosic material.

6. The method of claim 1, wherein painting at least a portion of the polymeric ferrule body with a paint material comprises painting a substantial portion of the outer surface of the ferrule body with the paint material.

7. The method of claim 1, wherein painting at least a portion of the ferrule body with a paint material comprises painting all of the outer surface of the ferrule body with the paint material.

8. The method of claim 1, wherein the ferrule is fixed to a shaft and a sleeve to form a shaft assembly, the shaft assembly being rotatably adjustable relative to a golf club head, wherein the markings on the ferrule visually indicate a rotational position of shaft assembly relative to the golf club head.

9. The method of claim 1, wherein the ferrule comprises a plurality of longitudinally oriented recesses and the markings are formed within the recesses.

10. The method of claim 1, wherein the markings comprise lines having average line widths of less than 1.0 mm.

11. The method of claim 1, wherein the markings comprise one or more outlined characters.

12. The method of claim 1, wherein the markings comprise informational markings that provide information related to at least one of a golf club lie angle, a golf club loft angle, a golf ball trajectory, or a golf club face angle.

13. The method of claim 1, wherein removing one or more portions of the paint material from the ferrule body comprises masking the ferrule body prior to painting and removing the masking to reveal portions of the ferrule body.

* * * * *